US006514157B2

(12) United States Patent
Jordan et al.

(10) Patent No.: US 6,514,157 B2
(45) Date of Patent: Feb. 4, 2003

(54) GOLF BALL WITH NON-AQUEOUS LIQUID CENTER

(75) Inventors: Michael D. Jordan, East Greenwich, RI (US); Jeffery L. Dalton, Dartmouth, MA (US)

(73) Assignee: Acushnet Company, Fairhaven, MA (US)

( * ) Notice: Subject to any disclaimer, the term of this patent is extended or adjusted under 35 U.S.C. 154(b) by 6 days.

(21) Appl. No.: 09/821,642

(22) Filed: Mar. 29, 2001

(65) Prior Publication Data

US 2002/0142862 A1 Oct. 3, 2002

(51) Int. Cl.[7] ..... A63B 37/08; A63B 37/00
(52) U.S. Cl. ..... 473/354; 473/351
(58) Field of Search ..... 473/351, 354, 473/363, 364, 367, 368, 369, 377

(56) References Cited

U.S. PATENT DOCUMENTS

| | | | | |
|---|---|---|---|---|
| 1,568,513 A | | 1/1926 | Lewis | |
| 1,904,012 A | | 4/1933 | Reichard | |
| 5,150,906 A | | 9/1992 | Molitor et al. | |
| 5,421,580 A | | 6/1995 | Sugimoto et al. | |
| 5,480,155 A | | 1/1996 | Molitor et al. | |
| 5,496,035 A | | 3/1996 | Gilchrist et al. | |
| 5,511,791 A | | 4/1996 | Ebisuno et al. | 473/354 |
| 5,597,365 A | | 1/1997 | Yamada et al. | 473/354 |
| 5,605,512 A | | 2/1997 | Yamada et al. | 473/354 |
| 5,609,532 A | | 3/1997 | Chikaraishi | 473/365 |
| 5,655,977 A | | 8/1997 | Kakiuchi et al. | 473/354 |
| 5,674,137 A | | 10/1997 | Maruko et al. | 473/354 |
| 5,683,311 A | | 11/1997 | Kakiuchi | 473/354 |
| 5,683,312 A | | 11/1997 | Boehm et al. | 473/354 |
| 5,792,008 A | | 8/1998 | Kakiuchi et al. | 473/354 |
| 5,816,937 A | | 10/1998 | Shimosaka et al. | 473/354 |
| 5,816,938 A | | 10/1998 | Kakiuchi | 473/354 |
| 5,827,133 A | | 10/1998 | Chang | 473/370 |
| 5,836,831 A | | 11/1998 | Stanton et al. | 473/354 |
| 5,846,142 A | | 12/1998 | Kakiuchi et al. | 473/354 |
| 5,919,100 A | * | 7/1999 | Boehm et al. | 273/DIG. 20 |
| 5,922,252 A | | 7/1999 | Stanton et al. | 264/4 |
| 6,174,245 B1 | | 1/2001 | Stanton et al. | 473/354 |
| 6,354,965 B1 | * | 3/2002 | Harris et al. | 473/351 |

FOREIGN PATENT DOCUMENTS

| | | | | |
|---|---|---|---|---|
| GB | 2182571 A | * | 5/1987 | A63B/37/02 |
| GB | 2299588 | | 10/1996 | |
| GB | 2300125 | | 10/1996 | |

* cited by examiner

*Primary Examiner*—Paul T. Sewell
*Assistant Examiner*—Alvin A. Hunter

(57) ABSTRACT

A golf ball having a diameter and being comprised of a core and a cover, wherein the core is further comprised of a non-aqueous liquid mass at the center of the ball. The ball includes a first solid layer surrounding the fluid mass and a second, layer surrounding and abutting the first layer. The first layer has an inner diameter of 15 to 70% of the ball diameter and is a polymeric material and the second layer has an outer diameter of 80 to 98% of the ball diameter.

19 Claims, 4 Drawing Sheets

GOLF BALL WITH NON-AQUEOUS LIQUID CENTER

FIELD OF THE INVENTION

The present invention is directed to a golf ball and, more particularly, a golf ball comprised of a non-aqueous fluid or liquid center. Surrounding the center is a first layer and a second, solid, non-wound layer and a cover.

BACKGROUND OF THE INVENTION

Generally, golf balls have been classified as solid balls or wound balls. Solid balls are generally comprised of a solid polymeric core and a cover. These balls are generally easy to manufacture, but are regarded as having limited playing characteristics. Wound balls are comprised of a solid or liquid filled center surrounded by tensioned elastomeric material and a cover. Wound balls generally have a good spin characteristics and feel when struck by a golf club, but are more difficult to manufacture than solid balls.

The prior art is comprised of various golf balls that have been designed to provide optimal playing characteristics. These characteristics are generally the initial velocity and spin of the golf ball, which can be optimized for various players. For instance, certain players prefer to play a ball that has a high spin rate for playability. Other players prefer to play a ball that has a low spin rate to maximize distance.

The prior art is also comprised of various liquid filled golf balls. Wound golf balls have been made with liquid centers for many years. Both U.S. Pat. Nos. 1,568,513 and 1,904,012 are directed to wound golf balls with liquid filled centers. U.S. Pat. Nos. 5,150,906 and 5,480,155, are directed to a hollow spherical shell of a polymeric material which is filled with a liquid or unitary, non-cellular material that is a liquid when introduced into the shell. The shell is disclosed as being the outer cover or an inner layer with the outer cover formed to the external surface thereof. The shell varies in thickness from about 0.060 to 0.410 inches in thickness.

SUMMARY OF THE INVENTION

Broadly, the present invention comprises a golf ball having a core and a cover in which the core is comprised of a non-aqueous liquid center surrounded by a solid portion. Preferably, the solid portion is comprised of a first layer surrounding the center and a second, solid, non-wound layer that is comprised of a thermoset rubber or thermoplastic elastomeric material. The solid portion of the core, preferably, has an inner diameter in a range of about 15 to 70% of the finished ball diameter and an outer diameter of about 80 to 98% of the finished ball diameter.

Still further, for a preferred golf ball having an outer diameter of approximately 1.68 inches, the first layer preferably has an inner diameter of approximately 0.25 to 1.18 inches and, more preferably, approximately 0.5 to 1.1. Most preferably, the first layer has an inner diameter of approximately 0.75 to 1.0 inches. The present invention is also preferably comprised of a second layer having an inner diameter in the range of 0.55 to 1.45 inches and, more preferably, having an inner diameter of approximately 0.8 to 1.3 inches. Yet further still, the present invention has a second layer having an outside diameter in the range of 1.3 to 1.65 inches and, more preferably, in the range of 1.45 to 1.62 inches. In the most preferred embodiment, the second layer has a radial thickness of about 0.2 to 0.3 inches.

More particularly, the invention is directed to a golf ball having a non-aqueous liquid filled center having a specific gravity and viscosity such that the performing properties of the ball, such as the moment of inertia, may be varied to achieve certain desired parameters such as spin rate, spin decay, compression, initial velocity, etc. Still further the fluid filled center preferably has a high specific gravity, i.e., greater than 1.2, for a high spin ball or a low specific gravity, i.e., less than 1.2 for a low spin ball.

DESCRIPTION OF THE PREFERRED EMBODIMENT

Figure 1:
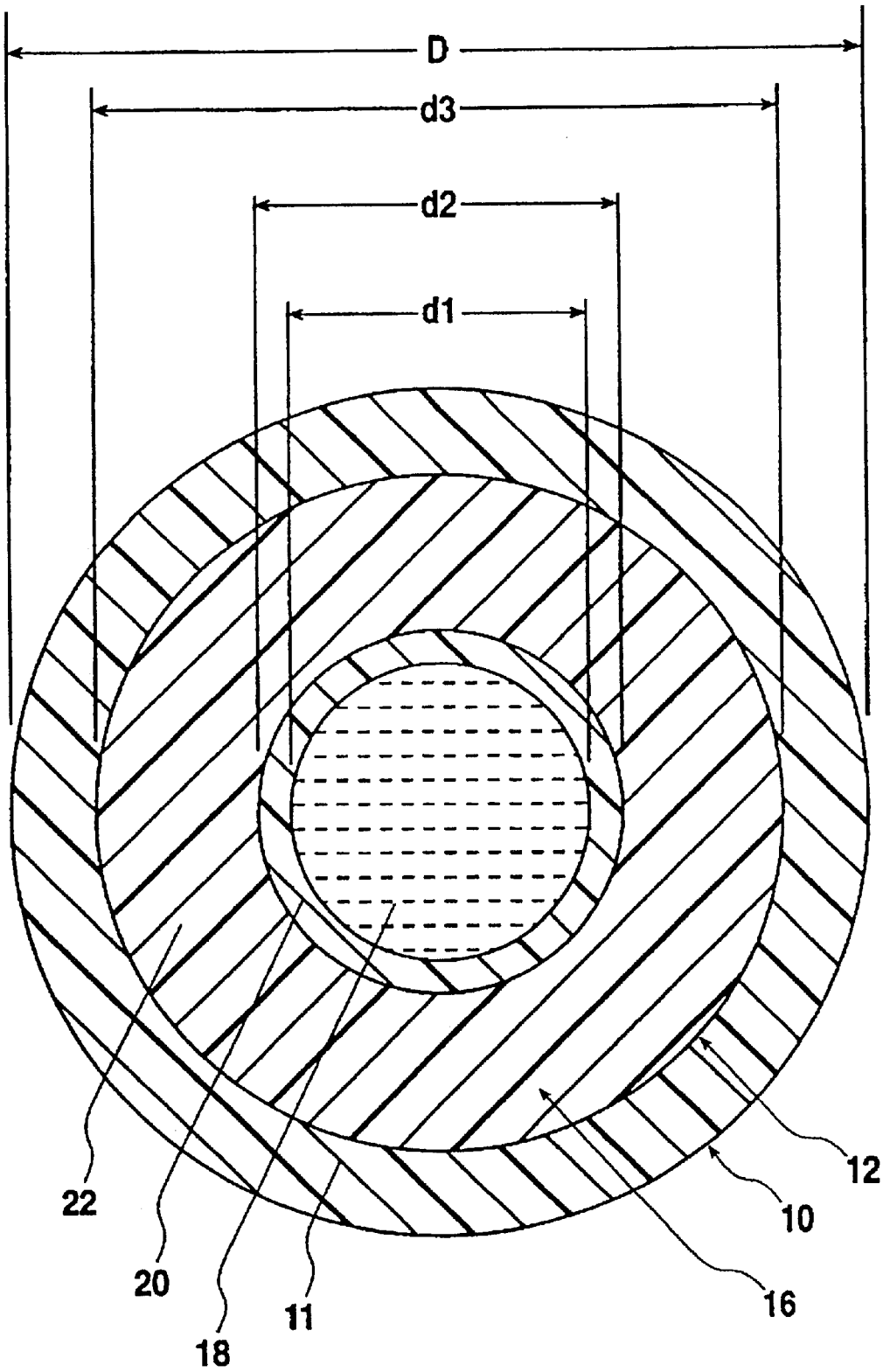
FIG. 1 is a sectional view of a ball of the present invention.

Referring to FIG. 1, ball 10 includes a cover 11 and a core 12. The core 12 in turn includes a non-aqueous liquid filled cavity or center 18 and a surrounding portion 16, which is comprised of a first, inner portion 20 and a second, outer portion 22.

The cover 11 provides the interface between the ball 10 and a club. Properties that are desirable for the cover are good flowability, high abrasion resistance, high tear strength, high resilience, and good mold release, among others. The cover 11 can be comprised of polymeric materials such as ionic copolymers of ethylene and an unsaturated monocarboxylic acid which are available under the trademark "SURLYN" of E. I. DuPont De Nemours & Company of Wilmington, Del. or "IOTEK" or "ESCOR" from Exxon. These are copolymers of ethylene and methacrylic acid or acrylic acid partially neutralized with zinc, sodium, lithium, magnesium, potassium, calcium, manganese, nickel or the like.

In accordance with the various embodiments of the present invention, the cover 11 is of a thickness to generally provide sufficient strength, good performance characteristics and durability. Preferably, the cover 11 is of a thickness from about 0.02 inches to about 0.12 inches. More preferably, the cover 11 is about 0.03 to 0.09 inches in thickness and, most preferably, is about 0.03 to 0.085 inches in thickness.

The cover 11 can also be comprised of one or more layers. For example, a preferred embodiment is disclosed in U.S. Pat. Nos. 5,885,172, which is incorporated by reference herein in its entirety.

In accordance with a preferred embodiment of this invention, the cover in question or a layer of the cover can be formed from mixtures or blends of zinc and/or lithium and sodium ionic copolymers.

Surlyn resins are ionic copolymers in which sodium, lithium or zinc salts are the reaction product of an olefin having from 2 to 8 carbon atoms and an unsaturated monocarboxylic acid having 3 to 8 carbon atoms. The carboxylic acid groups of the copolymer may be totally or partially neutralized and might include methacrylic, crotonic, maleic, fumaric or itaconic acid.

This invention can likewise use as a cover material or layer homopolymeric and copolymer materials such as:

(1) Vinyl resins such as those formed by the polymerization of vinyl chloride, or by the copolymerization of vinyl chloride with vinyl acetate, acrylic esters or vinylidene chloride.

(2) Polyolefins such as polyethylene, polypropylene, polybutylene and copolymers such as polyethylene methylacrylate, polyethylene ethylacrylate, polyethylene vinyl acetate, polyethylene methacrylic or polyethylene acrylic acid of polypropylene acrylic acid and copolymers and single-site catalytic polymers containing olefinic monomers.

(3) Polyurethanes such as those prepared from polyols and diisocyanates or polyisocyanates. For examples, see U.S. Pat. Nos. 5,334,673; 5,692,974; 5,947,843; and 6,042,619 which are incorporated by reference in their entirety.

(4) Polyamides such as poly(hexamethylene adipamide) and others prepared from diamines and dibasic acids, as well as those from amino acids such as poly(caprolactam), and blends of polyamides with Surlyn, polyethylene, ethylene copolymers, ethyl-propylene-non-conjugated diene terpolymer, etc.

(5) Acrylic resins and blends of these resins with poly vinyl chloride, elastomers, etc.

(6) Thermoplastic rubbers such as the urethanes, olefinic thermoplastic rubbers such as blends of polyolefins with ethyl-propylene-non-conjugated diene terpolymer, block copolymers of styrene and butadiene, or isoprene or ethylene-butylene rubber, polyether block amides, an example of such a product is sold under the trademark "Pebax" by Rilsan Industrial, Inc., Birdsboro, Pa. 19508.

(7) Polyphenylene oxide resins, or blends of polyphenylene oxide with high impact polystyrene as sold under the trademark "Noryl" by General Electric Company, Pittsfield, Mass.

(8) Thermoplastic polyesters, such as polyethylene terephthalate, polybutylene terephthalate, polyethylene terephthalate/glycol modified and elastomers sold under the trademarks "Hytrel" by E. I. DuPont De Nemours & Company of Wilmington, Del. and "Lomod" by General Electric Company, Pittsfield, Mass.

(9) Blends and alloys, including polycarbonate with acrylonitrile butadiene styrene, polybutylene terephthalate, polyethylene terephthalate, styrene maleic anhydride, polyethylene, elastomers, etc. and polyvinyl chloride with acrylonitrile butadiene styrene or ethylene vinyl acetate or other elastomers. Blends of thermoplastic rubbers with polyethylene, propylene, polyacetal, nylon, polyesters, cellulose esters, etc.

Preferably, the cover 11 is comprised of one or more layers that are injection molded, compression molded, cast or reaction injection molded.

Figure 1A:
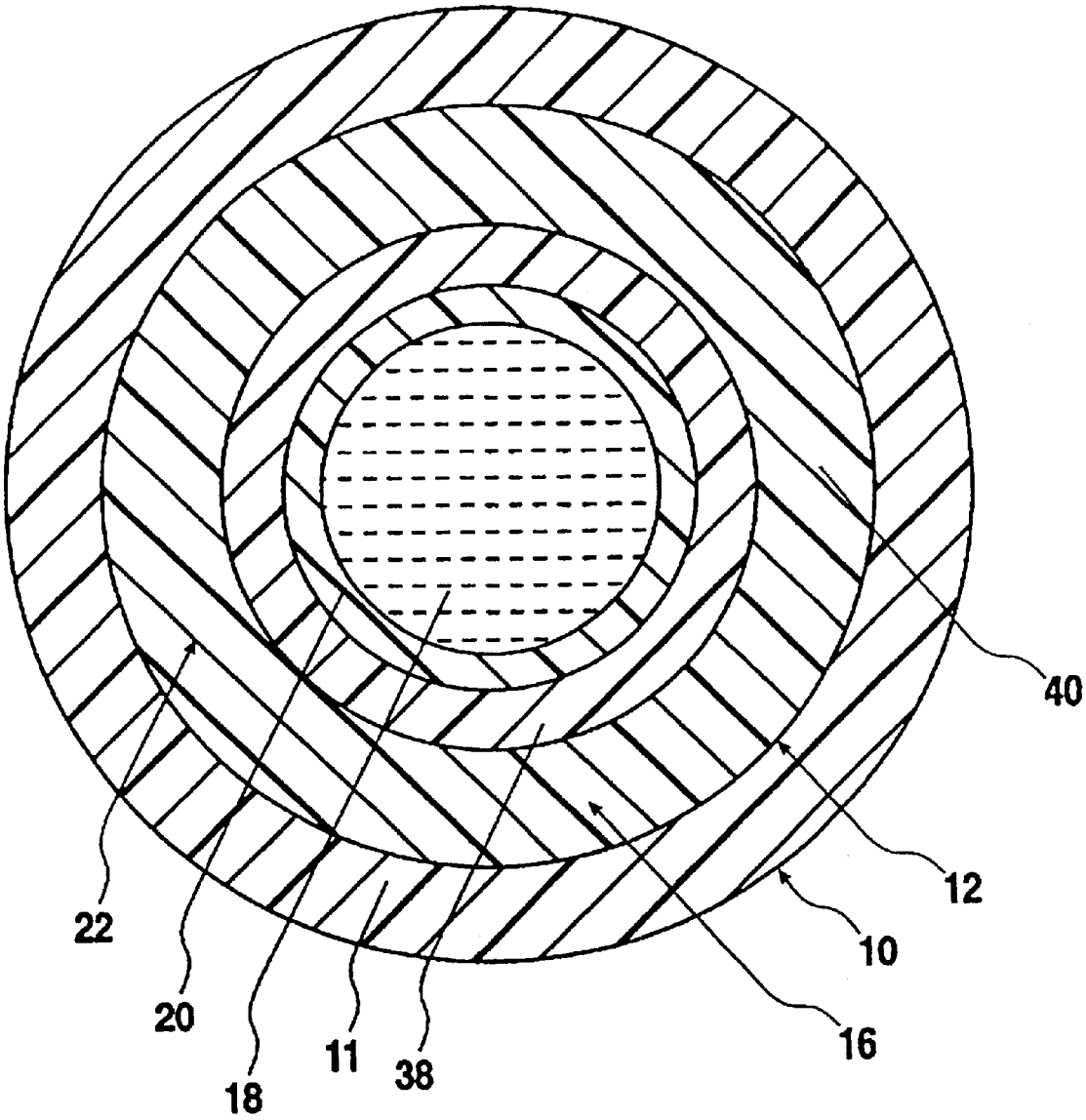
FIG. 1A is a sectional view of a ball of the present invention with a second layer having two layers.

The portion 16 is made of at least a first layer 20 surrounding the non-aqueous liquid or filled cavity or center 18 and a second layer 22 surrounding the first layer 20. The first layer 20 is preferably made of a thermoset rubber such as polyisoprene, styrene butadiene, polybutadiene and combinations thereof; a plastic, such as polypropylene; or a thermoplastic elastomeric material such as copolymers of methyl-methacrylate with butadiene and styrene, copolymers of methyl-acrylate with butadiene and styrene, acrylonitrile styrene copolymers, polyether-ester, polyether-amide, polyurethane and/or blends thereof. Most preferably, the first layer 20 is comprised of a flexible thermoplastic as set forth in U.S. Pat. No. 6,174,245, which is incorporated by reference herein in its entirety The portion 16 also comprises the second layer 22 surrounding the first layer 20. The second layer 22 is shown as a single layer, but can be one or more layers made from one or more materials. FIG. 1A shows the second layer 22 having two layers 38 and 40. The second layer 22 can be wound, but is preferably solid and is preferably made of thermoset rubber such as polyisoprene, styrene butadiene, polybutadiene and combinations thereof or thermoplastic elastomeric materials such as copolymers of methyl-methacrylate with butadiene and styrene, copolymers of methyl-acrylate with butadiene and styrene, acrylonitrile styrene copolymers, polyether-ester, polyether-amide, polyurethane and/or blends thereof. The portion 16 is preferably made according to U.S. Pat. Nos. 6,180,040; 6,180,722; 6,096,255 or 6,207,095 which are incorporated by reference herein in their entirety.

The portion 16 preferably has an outside diameter d3 in the range of 80 to 98% of the finished ball diameter D and an inner diameter d1 in the range of 15 to 70% of the finished ball diameter. Preferably, portion 16 and the first layer 20 have an inner diameter of approximately 0.25 to 1.18 inches and, more preferably, an inner diameter of approximately 0.5 to 1.1 inches. Preferably, the portion 16 and first layer 20 have an inner diameter of approximately 0.75 to 1.0 inches. The second layer 22 preferably has an inner diameter d2 in the range of 0.55 to 1.45 inches and, more preferably, approximately 0.8 to 1.3 inches. Yet further still, the portion 16 and the second layer 22 have an outside diameter in the range of 1.3 to 1.65 inches and, more preferably, approximately 1.45 to 1.62 inches. A golf ball incorporating these measurements can be designed with the various attributes discussed below, such as specific gravity, resiliency and hardness, to provide the desired playing characteristics, such as spin rate and initial velocity. More particularly, by using a first layer to surround the fluid or liquid center and at least a second layer, the specific gravities and other properties can be tailored to provide optimum playing characteristics. More particularly, by constructing a ball according to these dimensions, the second layer is made with a significant volume compared to the fluid center. Preferably, the volume of the second layer is greater than the volume of the fluid center. More preferably, the volume of the second layer is about 2 to 4 times the volume of the fluid center. Thus, the properties of the second layer can effect the playing characteristics of the ball.

The hardness and resiliency of the portion 16 can be varied to achieve certain desired parameters such as spin rate, compression and initial velocity.

Preferably, the portion 16 has a hardness of approximately 15 to 95 Shore C, and more preferably, 45 to 90 Shore C. Still further, the portion 16 has a resiliency greater than 40 bashore.

In a most preferred embodiment, the first layer 20 is comprised of a plastic material having high temperature resistance. The second layer 22 is comprised of a polybutadiene material that has high specific gravity for a low spin rate ball and a low specific gravity for a high spin rate ball. It is known that the specific gravity of the polybutadiene material can be varied by adding fillers known to those skilled in the art.

The fluid cavity or center 18 can be filled with a wide variety of materials including mixtures of glycerin, propylene glycol, diethylene glycol, and polyethylene glycol 200 MW and 400 MW in proportions from 0 to 100% yield specific gravities from about 1.0 to about Shore 1.3 with viscosities between 100 cps to 1000 cps and water activities less than 0.1. Since no water is present in the liquid center, no water can permeate the first layer 20 and cause size and/or velocity loss. The liquid in the center 18 can be varied to modify the performance parameters of the ball, such as the moment of inertia. Preferably, the liquid in the cavity 18 is comprised of a material that has a high specific gravity for high spin rate golf balls and a material that has a low specific gravity for a low spin rate golf ball. Preferably, the specific gravity of the fluid or liquid is below or equal to 1.2 for low specific gravity centers and above 1.2 for high specific gravity centers. More preferably, the specific gravity is approximately 1.0–1.2 for low specific gravity centers and approximately 1.3–1.55 for high specific gravity centers.

Still further, the fluid is preferably comprised of a material with a low viscosity for a golf ball having a high spin rate and a material having a high viscosity for a golf ball having a low spin rate. Preferably, the viscosity of the fluid or liquid center is less than 100 cps for low viscosity centers and greater than or equal to 100 cps for high viscosity centers. More preferably, the viscosity of the fluid or liquid center is less than or equal to 10 cps for low viscosity centers. The viscosity can be lowered by adding fillers such as pastes to form a suspension with a low viscosity. Preferably, the liquid viscosity is between 100 and 1500 cps for high viscosity centers. Most preferably, the liquid center viscosity is greater than about 500 cps for high viscosity centers.

The liquid can further include fillers such as hollow micropheries, metal particles, pastes, colloidal suspensions, such as clay, barytes, carbon black, other non-aqueous liquid or combinations of these to modify the specific gravity and/or the viscosity.

The core 12 is preferably 60 to 95% of the total ball weight and more preferably, 75 to 86% of the ball weight. As stated above, the weight distribution within the core 12 can be varied to achieve certain desired parameters such as spin rate, compression and initial velocity.

For example, by increasing the diameter of the fluid or liquid filled center cavity 18, and increasing the specific gravity of the portion 16, the weight distribution of the core is moved toward the outer diameter for a lower spin rate ball. In contrast, the diameter of the fluid or liquid filled center 18 can be decreased and the specific gravity of the layer 16 decreased to move the weight distribution of the ball towards the ball center for a high spin rate ball.

Similarly, the specific gravity of the fluid or liquid filled center can be decreased and the specific gravity of the portion 16 increased for a low spin rate ball. Alternatively, the specific gravity of the fluid or liquid filled center 18 can be increased and the specific gravity of the portion 16 decrease for a high spin rate ball.

Various examples of golf ball cores according to the invention are set forth below.

EXAMPLE 1

A core according to the present invention can be created having a non-aqueous liquid center, a first solid layer surrounding the liquid and a second solid layer surrounding the first layer.

The liquid is comprised of 90% glycerin and 10% propylene glycol. The liquid center has a specific gravity of about 1.23 and a viscosity of about 990 cps at room temperature. Preferably, the liquid center has an outside diameter of approximately 0.5 to 1.0 inches. To increase the specific gravity even further, a filler material having a specific gravity of greater than 4 can be added. The filler is preferably soluable or forms a homogeneous dispersion.

The first solid layer is preferably created from a thermoplastic elastomer. The first layer preferably has an outside diameter of approximately 1.0 to 1.25 inches.

The second solid layer is created from crosslinked polybutadiene. The second layer preferably has an outside diameter of approximately 1.51 to 1.62 inches.

The finished ball should weigh about 45 g and have an Atti compression of less than 90.

EXAMPLE 2

A core according to the present invention can be created having a non-aqueous liquid center, a first solid layer surrounding the liquid and a second solid layer surrounding the first layer.

The liquid is comprised of 80% glycerin and 20% propylene glycol. The liquid center has a specific gravity of about 1.21 and a viscosity of about 725 cps at room temperature. Preferably, the liquid center has an outside diameter of approximately 0.25 to .075 inches.

The first solid layer is preferably created from a thermoplastic elastomer. The first layer preferably has an outside diameter of approximately 1.0 to 1.25 inches.

The second solid layer is created from crosslinked polybutadiene. The second layer preferably has an outside diameter of approximately 1.51 to 1.62 inches.

The finished ball should weigh about 45 g and have an Atti compression of less than 90.

EXAMPLE 3

A core according to the present invention can be created having a non-aqueous liquid center, a first solid layer surrounding the liquid and a second solid layer surrounding the first layer.

The liquid is comprised of 70% glycerin and 15% propylene glycol. The liquid center has a specific gravity of about 1.19 and a viscosity of about 615 cps at room temperature. Preferably, the liquid center has an outside diameter of approximately 0.5 to 1.0 inches.

The first solid layer is preferably created from a thermoplastic elastomer. The first layer preferably has an outside diameter of approximately 1.0 to 1.25 inches.

The second solid layer is created from crosslinked polybutadiene. The second layer preferably has an outside diameter of approximately 1.51 to 1.62 inches.

The finished ball should weigh about 45 g and have an Atti compression of less than 90.

EXAMPLE 4

A core according to the present invention can be created having a non-aqueous liquid center, a first solid layer surrounding the liquid and a second solid layer surrounding the first layer.

The liquid is comprised of 50% glycerin and 50% propylene glycol. The liquid center has a specific gravity of about 1.14 and a viscosity of about 275 at room temperature. Preferably, the liquid center has an outside diameter of approximately 0.5 to 1.0 inches.

The first solid layer is preferably created from a thermoplastic elastomer. The first layer preferably has an outside diameter of approximately 1.0 to 1.25 inches.

The second solid layer is created from crosslinked polybutadiene. The second layer preferably has an outside diameter of approximately 1.51 to 1.62 inches.

The finished ball should weigh about 45 g and have an Atti compression of less than 90.

Figure 2:
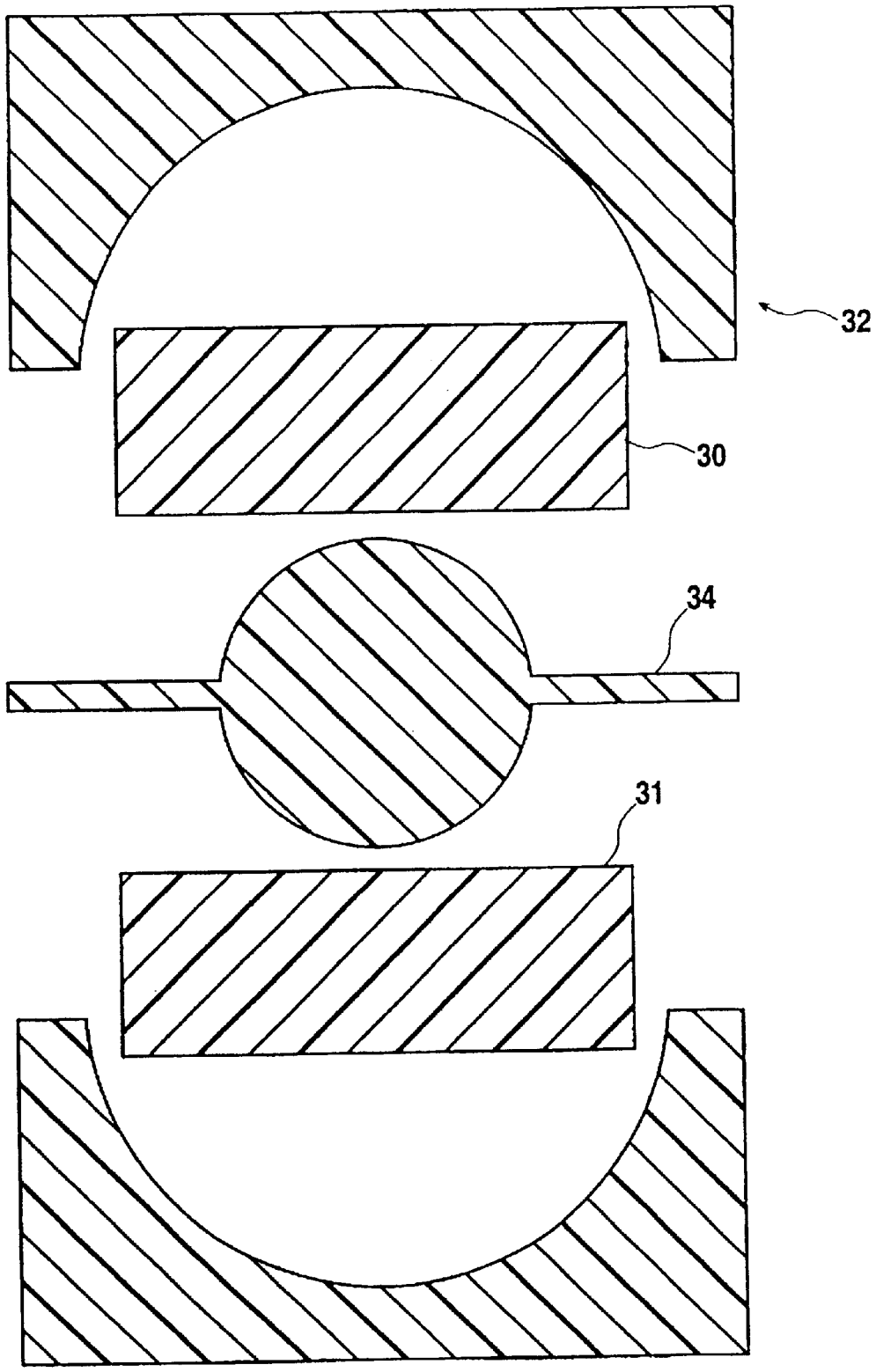
FIG. 2 is a sectional view of a mold forming a layer according to the present invention.
Figure 3:
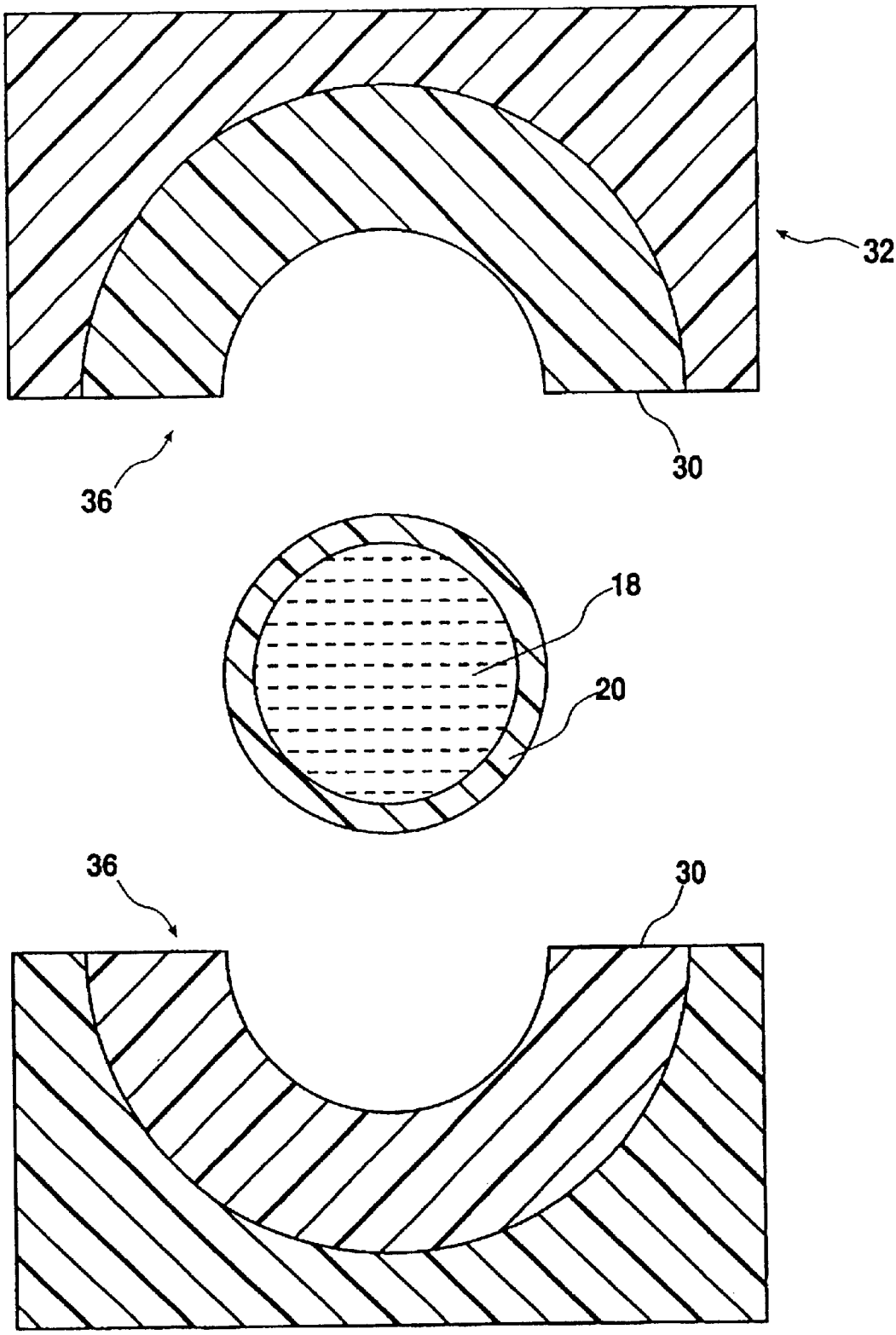
FIG. 3 is a sectional view of the mold forming a golf ball core according to the present invention.

Turning to FIGS. 2 and 3, a golf ball of the present invention can be formed by initially forming the first layer 20 to create cavity or center 18 and filling the cavity 18 with fluid or liquid. The second layer is formed by pre-forming top and bottom cups 30 and 31 of polybutadiene in a compression mold 32 with an inner fixture 34 as shown in FIG. 2. The mold 32 is then opened and the inner fixture 34 is removed, leaving a preform 36 in the top and bottom cups 30 and 31 of the second layer. The first layer 20 and fluid or liquid center 18 are then inserted into the bottom cup 31 and the mold 32 is closed and run through a normal temperature and pressure cycle to crosslink the second layer 22 to form the core 12. The cover 11 is then compression molded or injection molded over the core 12, which processes are well known in the art.

While it is apparent that the illustrative embodiments of the invention herein disclosed fulfills the objectives stated above, it will be appreciated that numerous modifications and other embodiments may be devised by those skilled in the art. Therefore, it will be understood that the appended claims are intended to cover all such modifications and embodiments which come within the spirit and scope of the present invention.

We claim:

1. A golf ball having a diameter and being comprised of a core and a cover, wherein the core is further comprised of a substantially non-aqueous liquid mass at the center of the ball, a first solid layer surrounding the fluid mass and a second, layer surrounding and abutting the first layer, wherein the first layer has an inner diameter of 15 to 70% of the ball diameter and is a polymeric material and the second layer has an outer diameter of 80 to 98% of the ball diameter, wherein the liquid is a solution comprising glycerine and propylene glycol.

2. The golf ball of claim 1 wherein the golf ball diameter is approximately 1.68 inches.

3. The golf ball of claim 1, wherein the liquid has a water activity of less than about 0.1.

4. The golf ball of claim 1 wherein the golf ball diameter is approximately 1.68 inches and the first layer has an inner diameter of approximately 0.25 to 1.18 inches.

5. The golf ball of claim 1 wherein the golf ball diameter is approximately 1.68 inches and the first layer has an inner diameter of approximately 0.5 to 1.1 inches.

6. The golf ball of claim 1 wherein the golf ball diameter is approximately 1.68 inches and the second layer has an inner diameter of approximately 0.55 to 1.45 inches.

7. The golf ball of claim 1 wherein the golf ball diameter is approximately 1.68 inches and the second layer has an inner diameter of approximately 0.8 to 1.3 inches.

8. The golf ball of claim 1 wherein the golf ball diameter is approximately 1.68 inches and the second layer has an outer diameter of approximately 1.3 to 1.65 inches.

9. The golf ball of claim 1 wherein the golf ball diameter is approximately 1.68 inches and the second layer has an outer diameter of approximately 1.45 to 1.62 inches.

10. The golf ball of claim 1 wherein the second layer is a solid, non-wound layer.

11. The golf ball of claim 10 wherein the second layer is comprised of more than one layer.

12. The golf ball of claim 1 wherein the fluid has a specific gravity of greater than 1.2.

13. The golf ball of claim 1 wherein the fluid has a viscosity of less than or equal to 100 cps.

14. The golf ball of claim 1 wherein the fluid has a viscosity of about 100 to 1500 cps.

15. The golf ball of claim 1 wherein the fluid has a specific gravity of less than or equal to 1.2.

16. The golf ball of claim 1 wherein the fluid has a specific gravity of approximately 1.15 to 1.2 and a viscosity of approximately 100 to 1500 cps.

17. A golf ball having a diameter of approximately 1.68 to 1.90 inches and comprising:

a non-aqueous liquid mass at the center of the ball, wherein the liquid is a solution comprising glycerine and propylene glycol;

a first, solid, non-wound layer surrounding the liquid mass comprised of a polymer material selected from the group of thermoset rubber material, thermoplastic elastomeric material and plastic and having an inner diameter in the range of 15 to 70% of the ball diameter;

a second, solid, non-wound layer surrounding and abutting the first layer and being a polymer material selected from the group of thermoset rubber material and thermoplastic elastomeric material and having an outer diameter in the range of 80 to 98% of the ball diameter, a hardness of approximately 15 to 95 Shore C and a resiliency greater than 40 bashore; and a cover of at least one layer surrounding the second layer.

18. The golf ball of claim 17 wherein the cover is comprised of a first cover layer comprising a material selected from the group of ethylene, propylene, butene-1 and hexane-1 based homopolymers and copolymers.

19. The golf ball of claim 18, wherein the cover is comprised of a second cover layer surrounding the fist cover layer comprising a material selected from the group of thermoplastic urethane, thermoset polyurethane, ionomer resins, low modulus ionomers, high modulus ionomers and blends thereof.

* * * * *